US007004889B2

(12) United States Patent
McBride

(10) Patent No.: US 7,004,889 B2
(45) Date of Patent: Feb. 28, 2006

(54) GRASPING AND LIFTING AID

(76) Inventor: James McBride, 606 W22, Vancouver BC (CA) V5Z 1Z6

( * ) Notice: Subject to any disclaimer, the term of this patent is extended or adjusted under 35 U.S.C. 154(b) by 672 days.

(21) Appl. No.: 10/166,502

(22) Filed: Jun. 11, 2002

(65) Prior Publication Data

US 2003/0148861 A1 Aug. 7, 2003

(30) Foreign Application Priority Data

Feb. 1, 2002 (CA) ..... 2369757

(51) Int. Cl.
*A63B 21/06* (2006.01)

(52) U.S. Cl. ..... 482/92; 482/49; 482/50

(58) Field of Classification Search ..... 482/92, 482/93, 99, 106, 139, 148, 49–50; 602/21, 602/5, 64; 2/20; 128/879
See application file for complete search history.

(56) References Cited

U.S. PATENT DOCUMENTS 5,267,943 A 12/1993 Dancyger
5,295,269 A 3/1994 Ballard
5,350,343 A 9/1994 DaSilva
5,620,399 A 4/1997 Hofmann
5,770,297 A 6/1998 Grubich
5,813,950 A * 9/1998 Parker ..... 482/93
6,146,319 A * 11/2000 Tarail ..... 482/139
6,564,385 B1 * 5/2003 McCarthy ..... 2/16

* cited by examiner

*Primary Examiner*—Glenn E. Richman
(74) *Attorney, Agent, or Firm*—Frederick Kaufman

(57) ABSTRACT

The grasping and lifting aid, according to the present invention, comprises a flexible strap having a first and second end portion. Doubling back and fixedly securing the first end portion to a remainder of the flexible strap, a first loop is formed. The first loop has an opening commensurate with a width of the flexible strap, so that the second end portion can freely pass through. Thus, a second loop adaptable for attaching about a user's wrist is formed. The flexible strap includes a wrist securing portion formed by the second loop, followed by a palm grasping portion having a length adaptable to be spirally wrapped around a weight bar or the like by using several coils in close proximity to each other, without overlapping. The flexible strap also has anti-slip proprieties on a side adaptable for confronting a palm, fingers and thumb of a user. A material for providing anti-slip proprieties is used. Thus, hand-gripping capacity is enhanced and the user is protected from getting painful skin damage on the hand. No material for providing anti-slip proprieties is used for the other side of the flexible strap, which is opposite to the side of the flexible strap that confronts the palm, fingers and thumb. Thus, when a user is overwhelmed by a load and forced to drop it, the other side of the flexible strip, not provided with an anti-slip material, will rapidly disengage from the weight bar and, thereby, provide security for the user.

4 Claims, 4 Drawing Sheets

GRASPING AND LIFTING AID

I. BACKGROUND OF THE INVENTION

1. Field of the Invention

This invention relates generally to devices for enhancing hand gripping capacity during load lifting, and more particularly to a grasping and lifting aid designed to strengthen the weight lifter's grip and prevent weight training injuries.

2. Description of the Related Prior Art

Weight lifting constitutes a largely practiced type of sport that involves both men and women. In addition to being a type of sport, weight lifting is also utilized as a conditioning practice for other types of sport.

In weight lifting, the small muscles of the forearm, which direct the finger flexors to grip a weight bar for example, are used. These small muscles are required to lift a load for the purpose of conditioning, by repetition, the large back muscles.

It is obvious that significant weights and a great number of exercises are necessary to enhance the capability of a large muscle group, such as the trapezius and back muscles. Since the forearm muscles tire more quickly then the above mentioned large muscle groups, which are intended to be exercised, the user is exposed to the risk of prematurely dropping the load, or is forced to quit exercising untimely.

Attempts have been made in the past to address the foregoing situation. U.S. Pat. No. 5,813,950 dated Sep. 29, 1998 and granted to Parker for a "Grip Assist Apparatus" discloses an apparatus featuring a flexible gripping portion. The latter covers the palm of the lifter and provides a non-slip surface. A thicker, flexible top end of the gripping portion comes in direct contact with the weight bar and can be positioned between the bar and the lifter's hand. The grip assist apparatus also has a padded wrist portion that has two elongated flaps such that when the flaps are tightened around the lifter's wrist and base of the hand, they form a funnel-like opening.

Parker's apparatus presents several important deficiencies. First, one edge of the flexible gripping portion has a dimension which varies accordingly for very large or petite hands, even if one size would be able to accommodate a large variety but not all of hand sizes. Thus, a one-size-fits-all solution is not envisaged for this grip apparatus. Second, the flexible gripping portion is provided with a top portion containing a reinforced insert, which is approximately two inches long, and about ⅛ of an inch thick. This causes some fingers to be raised an extra ⅛ of an inch from the weight bar, resulting in an uneven grip. Furthermore, the flexible gripping portion does not cover all the fingers. Third, the wrist portion, when its flaps are tightened, forms a funnel-like opening that is larger at the distal end then at the proximal end. Thus, the grip assist apparatus wouldn't fit properly and smoothly against the wrist. Fourth, the apparatus is complicated. Use is made of wrist cushions, Velcro™ attachment, several stitched zones, etc. Since Parker's apparatus is designed to fit the hand in a particular manner, a left-handed and a right-handed version are required. Parker recommends that the latter are marked accordingly to prevent a user from mistaking a left for a right version. U.S. Pat. No. 5,809,570 dated Sep. 22, 1998 and granted to Grover for a "Wrist Harness Strap" relates to a device to be used in securing a grip around any round-like object. The device comprises a wrist strap for encircling the wrist of the user, a ring adapted to be attached to a grip pad, and a pair of straps. Each of the straps have an attached end and a free end. The attached end is secured to the wrist strap near the back of the wrist, proximally to the point of attachment of the ring. One strap is attached near each side of the wrist. Each of those straps is provided with a securing feature near the free end, so that one of the straps may be passed over a side of the wrist, passed through the ring and secured to the wrist strap. Grover's patent contains several short comings. First, as can be seen from the above description, the device is complicated. Second, it uses a Velcro™ attachment, which requires a second hand for fastening and does not provide a safe securement. U.S. Pat. No. 5,592,694 dated Jan. 14, 1997 and granted to Yewer, Jr. for a "Wrap Type Hand Glove" describes a sport glove of the type that is used for weight lifting, water skiing, and other activities. The glove has a palm panel, a back panel secured to a thumb side of the palm panel, a wrist wrap panel extending for the side of the back panel, which is opposite from the palm panel, and a tab extending from a side of the palm panel which is opposite from the back panel. A palm pad is secured on the other surface of the palm panel. A wrist-fastening patch is secured to the outer side of the tab. A second fastening patch is secured to the inner surface of the back panel. First and second fastenings are hook and loop type patches. A third fastening patch is secured on the outer surface of the wrist wrap panel. A fourth fastening patch is secured to a free end of the wrist wrap panel. Third and fourth fastening patches are male and female Velcro ™ panels. As can be seen from the forgoing description of Yewer, Jr.'s patent, the glove is complicated and cumbersome.

In conclusion, one can say that many of the prior art designs are complicated and cumbersome to use, and have a short-lived life.

II. SUMMARY OF THE INVENTION

It is an objective of the present invention to provide a grasping and lifting aid characterized by simplicity and reliability and, as a direct result of comparatively lower material and labour costs, reduces the total cost. Such savings may be passed to the users, which constitutes an undeniable advantage.

It is another objective of the present invention to develop a one-size-fits-all design.

It is another objective of the present invention to provide an aid that is self-conforming and comfortable in use, and is capable of being securely and readily applied to the wrist and very quickly disengaged from the weight bar.

It is another objective of the present invention to provide a compact and easy to wear aid, which prevents the circulation from being restricted to the lifter's hand, yet still enabling it to be firmly attached about the wrist without subjecting the lifter to any undue discomfort.

Broadly stating, the grasping and lifting aid, according to the present invention, comprises a flexible strap having a first and second end portion. Doubling back and fixedly securing the first end portion to a remainder of the flexible strap, a first loop is formed. The first loop has an opening commensurate with a width of the flexible strap, so that the second end portion can freely pass through. Thus, a second loop adaptable for attaching about a user's wrist is formed. The flexible strap includes a wrist securing portion formed by the second loop, followed by a palm grasping portion having a length adaptable to be spirally wrapped around a weight bar or alike by using several coils in close proximity to each other, without overlapping. The flexible strap also has anti-slip proprieties on a side adaptable for confronting a palm, fingers and a thumb of a user. Means for providing anti-slip proprieties is used. Thus, hand-gripping capacity is enhanced and the user is protected from getting painful skin damage of the hand. No means for providing anti-slip proprieties is used for another side of the flexible strap, opposite to the side of the flexible strap, which confronts a palm, fingers and a thumb. Thus, when a user is overwhelmed by a load of a weight bar and forced to drop it, another side of the flexible strip will rapidly disengage from the weight bar and, whereby, improve the security of the user.

In one aspect of the invention, the means for providing anti-slip proprieties is obtained by applying a coating of a material having an appropriate friction capability for firmly gripping.

In another aspect of the invention, the means for providing anti-slip proprieties comprises an anti-slip pad securely attached to the flexible strap.

In yet another aspect of this invention, the means for providing anti-slip proprieties is adaptable to extend towards an user's wrist, beyond the side of the flexible strap adaptable for confronting a palm, fingers and a thumb of a user.

III. DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming part thereof, wherein like reference numerals refer to like parts throughout the several views in which:

IV. DESCRIPTION OF A PREFERRED EMBODIMENT

Figure 1:
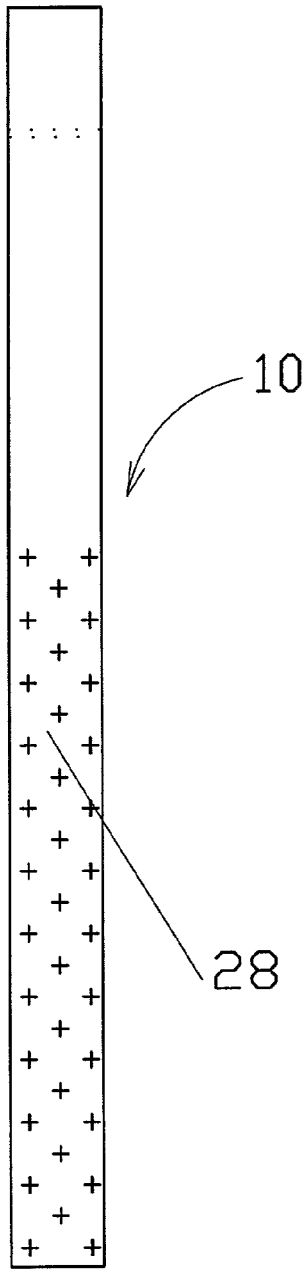
FIG. 1 is a front view of a grasping and lifting aid, according to the present invention, showing an anti-slip coated contact surface of a flexible strap, intended to face the palm, fingers and thumb of a user.
Figure 2:
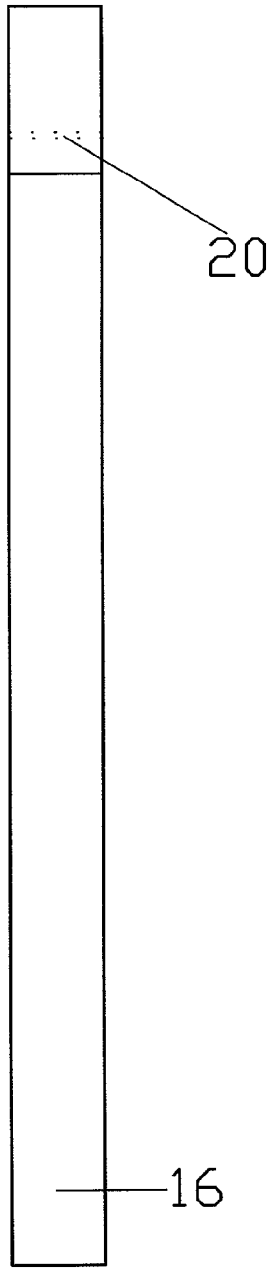
FIG. 2 is a front view of a grasping and lifting aid, showing a face of the flexible strap, opposite to the anti-slip coated contact surface and intended to face a weight-bar.
Figure 3:
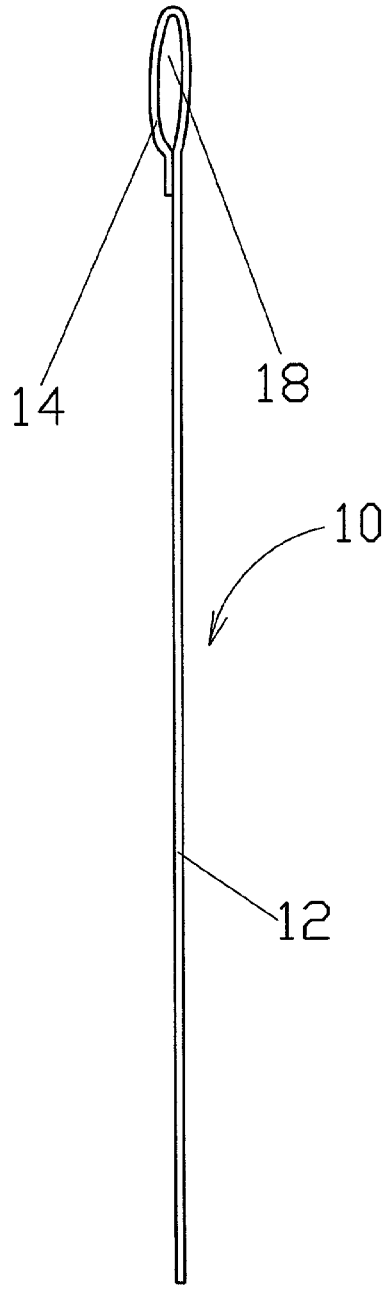
FIG. 3 depicts a side view of the grasping and lifting aid of FIG. 1.
Figure 4:
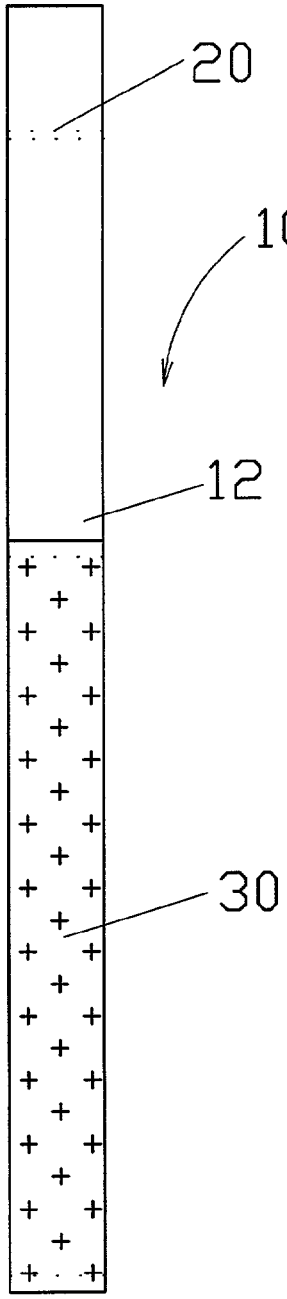
FIG. 4 is a front view of a grasping and lifting aid showing a face of a flexible strap provided with an anti-slip pad.
Figure 5:
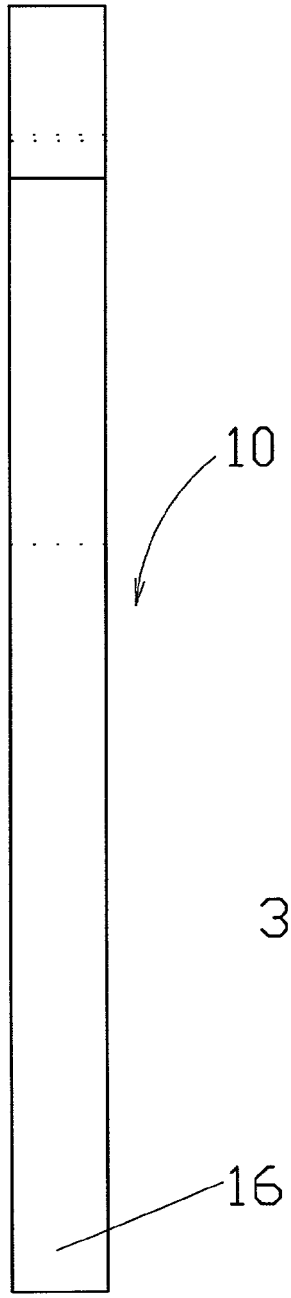
FIG. 5 is a front view of a grasping and lifting aid, showing a face of the flexible strap, opposite to the face provided with the anti-slip pad.
Figure 6:
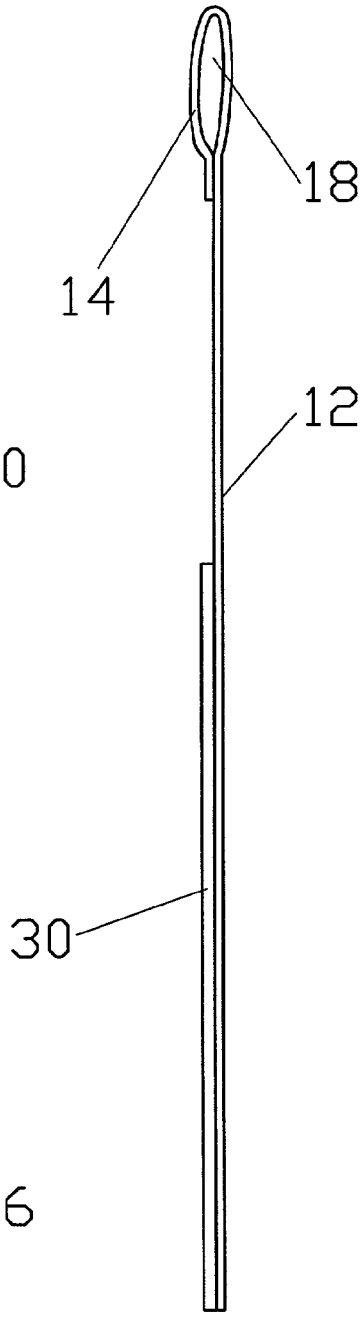
FIG. 6 depicts a side view of the grasping and lifting aid of FIG. 4.
Figure 7:
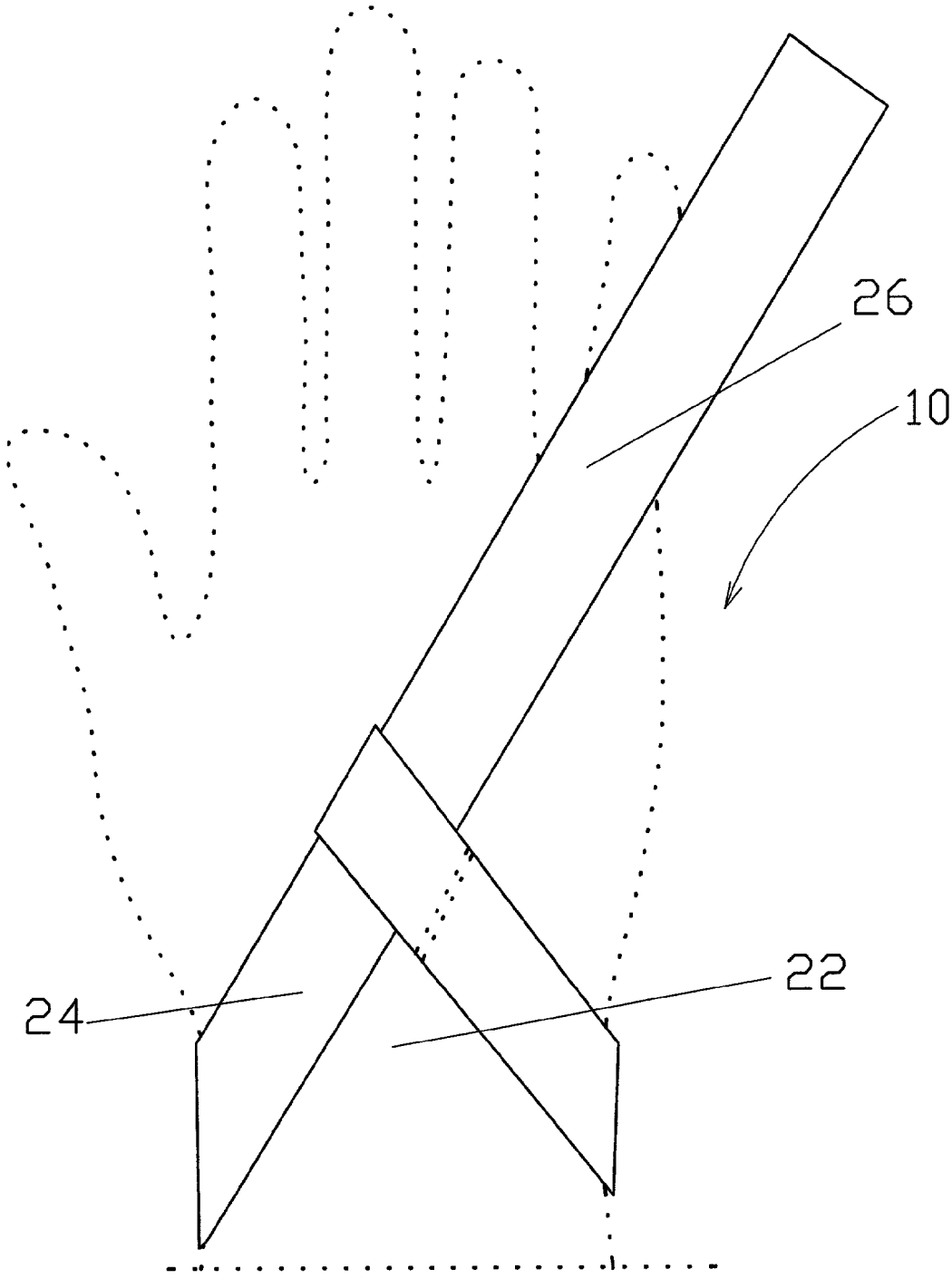
FIG. 7 depicts a flexible strap wrapped around a wrist.
Figure 8:
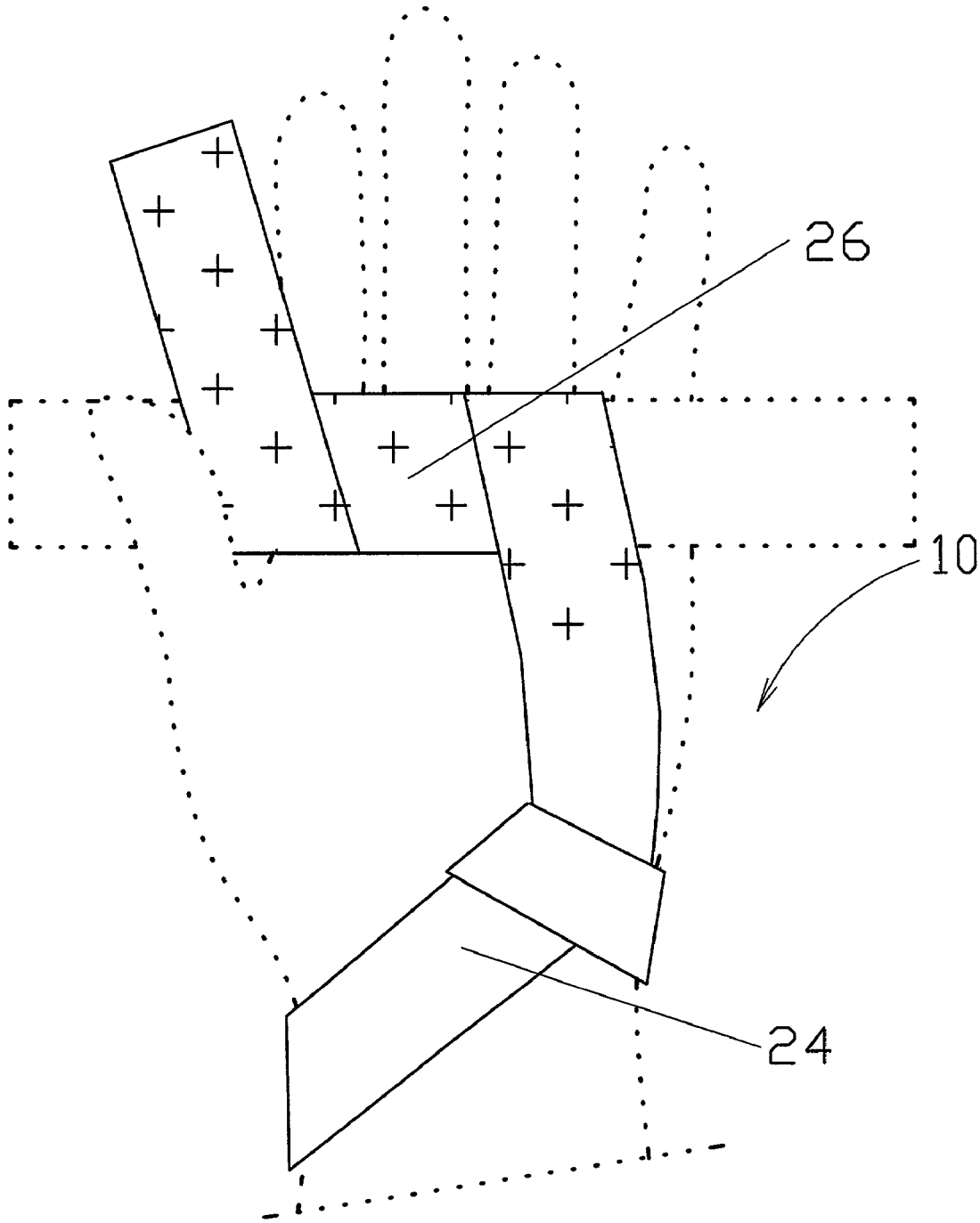
FIG. 8 depicts a flexible strap wrapped around a wrist and a weight bar.

An embodiment of a grasping and lifting aid, according to the present invention, is shown in FIGS. 1 to 8 and is generally depicted by reference number 10. Grasping and lifting aid 10 comprises a flexible strap 12 having a first and second end portion 14 and 16, respectively. First end portion 14 is doubled back to form a first loop 18. The latter has a folded over extremity fixedly attached to a remainder of flexible strap 12 via a stitched seam 20. While seam 20 is preferably stitched, other manners of fastening can be equally contemplated. Note that an opening of first loop 18 is commensurate with a width of flexible strap 12, so that second end portion 16 can freely pass through and form a second loop 22 into which a user's wrist is inserted. When attaching grasping and lifting aid 10 to a user's wrist, second end portion 16, already inserted through first loop 18 and forming second loop 22, is pulled against the user's wrist, around the base of the hand. The use of first and second loops 18 and 22, respectively, makes grasping and lifting aid 10 adjustable to various diameter wrists. Grasping and lifting aid 10 comprises a wrist-securing portion 24 followed by a palm-grasping portion 26. The former constitutes the sole means for attachment to the user's wrist, while the latter, formed by a length of flexible strap 12, is spirally wrapped around a weight bar. The foregoing length is selected so that when wrist-securing portion 24 is attached and secured about the user's wrist, several consecutive spiral coils, located in close proximity to each other, without overlapping, form palm-grasping portion 26 when wrapped around the weight bar. Palm-grasping portion 26 comes in contact with the whole surface of the palm, including all fingers and the thumb.

Flexible strap 12 is usually made from non-stretchable cotton.

It is important to firmly grasp the weight bar, with no danger that the weight bar can slip during an exercise which can occur due to the slippery nature of a regular strap against the hand. Therefore, a contact surface 28 of palm grasping portion 26, which is held against the palm by the grip of the hand, must prevent a slippage of the weight bar and, consequently, the user from potentially dropping the latter and sustaining injuries and/or getting painful skin damage on the hand. Moreover, a firm grip due to contact surface 28, designed to prevent slippage, augments the user's capacity to lift and hold heavier loads. From the foregoing explanation, one can infer that contact surface 28 of palm grasping portion 26, which is in direct contact with the palm, fingers and thumb, must possess a relatively high coefficient of friction. The inventor has arrived at the conclusion that a thermal plastic rubber can be applied as an anti-slip coating to form contact surface 28. Plasti Dip™ is a commercial thermal plastic rubber product sold by PDI Inc., Minnesota. Other types of material offering such anti-slip properties would also be acceptable, as long as they allow contact surface 28 to better adhere the user's palm, fingers and thumb to flexible strap 12, thus preventing slippage of the hand against flexible strap 12, and also the latter from unraveling. For example, besides Plasti Dip™, whole or part of flexible strap 12 can be made from a rubber-coated nylon. A rubber coating provides a non-slip surface, while an opposite non-grip surface is provided by the non-coated nylon surface. Usual materials such as leather, cotton, or the like lose any initial non-slip properties they had, once these materials have been used, for a relatively short period of time, for the purpose of this invention. Even when new, these materials do not offer appropriate anti-slip properties.

As results from the foregoing disclosure, contact surface 28 can be obtained by applying a coating of a rubber, rubber-like resilient material, or other material, which provides an appropriate friction for secure gripping.

In one variant, contact surface 28, besides confronting the palm, fingers and thumb of the user, extends towards the wrist-securing portion 24 of flexible strap 12. This reinforces flexible strap 12 in an area that is repeatedly subjected to high strain, thereby extending its durability.

An anti-slip pad 30 fixedly attached via a stitched seam to flexible strap 12 can substitute contact surface 28 applied by coating. Besides stitching, gluing, etc., other known means can be used to attach anti-slip pad 30.

In the case that a user is overwhelmed by a heavy load and forced to drop it, a surface of flexible strap 12, which is in direct contact with the weight bar, being opposite to contact surface 28 or to anti-slip pad 30, and is not provided with anti-slip proprieties, will rapidly disengage from the weight bar or the like. This greatly enhances the safety of the user.

As required, a detailed embodiment of the present invention is disclosed, however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The embodiments of the invention in which an exclusive property or privilege is claimed are defined as follows:

1. Grasping and lifting aid comprising, in combination, a flexible strap having a first and second end portion;

a first loop formed by doubling back and fixedly securing said first end portion to a remainder of said flexible strap, said first loop having an opening generally commensurate with a width of said flexible strap, so that said second end portion can freely pass through and, thus forming a second loop adaptable for attaching about a user's wrist;

said flexible strap including a wrist securing portion formed by said second loop, followed by a palm grasping portion having a length, adaptable to be spirally wrapped around a weight bar or the like, thus forming several coils in close proximity to each other without overlapping, and also having anti-slip proprieties on a side of said flexible strap adaptable for confronting a palm, fingers and a thumb of a user;

means for providing anti-slip proprieties;

whereby hand gripping capacity is enhanced and the user is protected from getting painful skin damage on the hand, while another side of said flexible strap, opposite to said side of said flexible strap confronting a palm, fingers and thumb, is not provided with means for providing anti-slip proprieties, so that when a user is overwhelmed by a load and forced to drop the latter, said another surface of said flexible strap will rapidly disengage, and thus, augment the security of the user.

2. Grasping and lifting aid, as defined in claim 1, wherein said means for providing anti-slip proprieties comprises a coating of a material having friction capabilities for secure gripping.

3. Grasping and lifting aid, as defined in claim 1, wherein said means for providing anti-slip proprieties comprises an anti-slip pad fixedly attached to said flexible strap.

4. Grasping and lifting aid, as defined in claim 1, wherein said means for providing anti-slip proprieties is adaptable to extend towards a user's wrist, beyond said part of said flexible strap adaptable to confront a palm, fingers and thumb of a user.

* * * * *